US008009119B2

(12) United States Patent
Hung

(10) Patent No.: US 8,009,119 B2
(45) Date of Patent: Aug. 30, 2011

(54) MULTIBAND ANTENNA

(75) Inventor: Chung-Yu Hung, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 216 days.

(21) Appl. No.: 12/486,020

(22) Filed: Jun. 17, 2009

(65) Prior Publication Data

US 2010/0123641 A1 May 20, 2010

(30) Foreign Application Priority Data

Nov. 14, 2008 (CN) ..... 2008 1 0305561

(51) Int. Cl.
*H01Q 1/24* (2006.01)
*H01Q 21/30* (2006.01)

(52) U.S. Cl. ..... 343/893; 343/702; 343/846; 343/828

(58) Field of Classification Search ..... 343/700 MS, 343/702, 893, 828, 846
See application file for complete search history.

(56) References Cited

U.S. PATENT DOCUMENTS 6,094,179 A * 7/2000 Davidson ..... 343/895
7,598,921 B2 * 10/2009 Ge et al. ..... 343/806
7,659,866 B1 * 2/2010 Peng et al. ..... 343/893
7,728,776 B2 * 6/2010 Lin et al. ..... 343/702
7,911,391 B2 * 3/2011 Tsai et al. ..... 343/700 MS
7,924,230 B2 * 4/2011 Hung et al. ..... 343/702

* cited by examiner

*Primary Examiner* — Douglas W Owens
*Assistant Examiner* — Jennifer F Hu
(74) *Attorney, Agent, or Firm* — Altis Law Group, Inc.

(57) ABSTRACT

A multiband antenna includes a first antenna unit for receiving/sending wireless signals having higher frequencies and a second antenna unit for receiving/sending wireless signals having lower frequencies than those frequencies received/sent by the first antenna unit. The first antenna unit includes a first main portion, a first resonating portion and a first connecting portion connected in order and positioned in a same plane. The second antenna unit includes a second connecting portion, a second resonating portion and a second main portion connected in order. The second connecting portion is coplanar with the first connecting portion, the second resonating portion is perpendicular to the second connecting portion, and the second main portion is perpendicular to both the first connecting portion and the second connecting portion.

12 Claims, 3 Drawing Sheets

MULTIBAND ANTENNA

BACKGROUND

1. Technical Field

The present disclosure relates to multiband antennas, and particularly to a multiband antenna for wireless cards.

2. Description of Related Art

Wireless cards are widely used in portable electronic devices such as mobile phones, personal digital assistants (PDA) and laptop computers. Antennas are used in such wireless cards to receive/send wireless signals. Generally, an antenna of a wireless card may receive/send wireless signals of different frequencies (e.g., DCS1800, PCS1900, UMTS2100, etc.), requiring that the antenna be a multiband antenna.

However, most conventional multiband antennas have complicated structures and are large in size, while many wireless cards are small with insufficient space to install the multiband antennas. Even if some miniaturized multiband antennas can be installed in wireless cards, they are difficult to be installed precisely. Thus, communication quality of the wireless card may be affected.

Therefore, there is room for improvement within the art.

BRIEF DESCRIPTION OF THE DRAWINGS

Many aspects of the present multiband antenna can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 1:
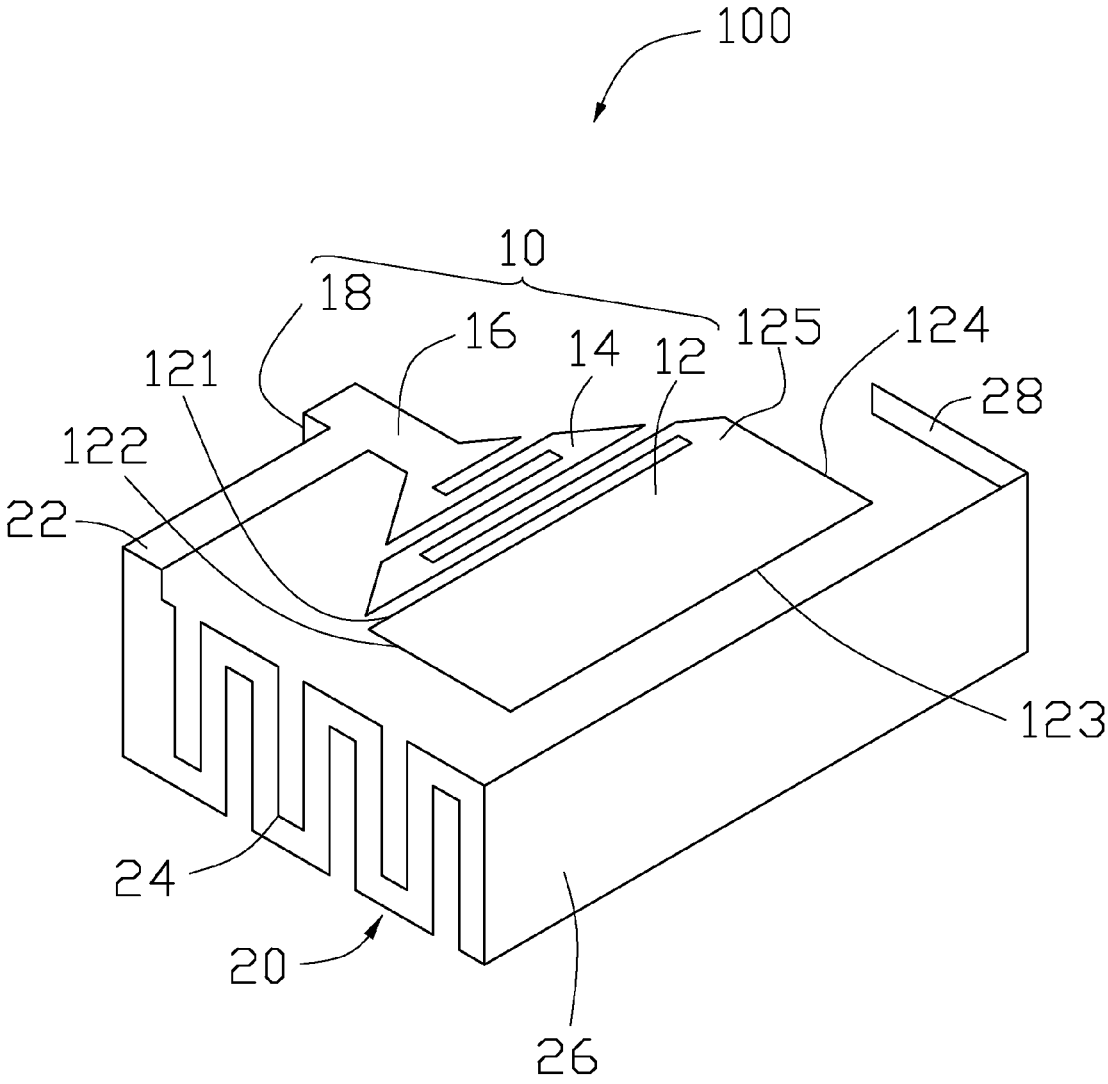
FIG. 1 is a schematic view of a multiband antenna, according to an exemplary embodiment.

FIG. 1 schematically shows a multiband antenna 100 according to an exemplary embodiment, for use in wireless cards. The multiband antenna 100 is made of conductive materials, such as metal. The multiband antenna 100 includes a first antenna unit 10 and a second antenna unit 20 connected to the first antenna unit 10. The first antenna unit 10 is used to receive or send wireless signals having higher frequencies, and the second antenna unit 20 is used to receive or send wireless signals having lower frequencies.

The first antenna unit 10 includes a first main portion 12, a first resonating portion 14, a first connecting portion 16 and a first feed portion 18. The first main portion 12 is a rectangular sheet, which includes two parallel longer sides 121, 123 and two parallel shorter sides 122, 124 perpendicular to the sides 121, 123. The side 121 intersects the side 124 at a corner 125.

The first resonating portion 14 is a zigzag sheet connected to the first main portion 12 and coplanar with the first main portion 12. One end of the resonating portion 14 is connected to the corner 125, and the first resonating portion 14 extends in a zigzag from the corner 125. First, the first resonating portion 14 extends parallel to the side 121 to form a first resonating section (not labeled), wherein the first resonating section is approximately as long as the side 121. Second, the first resonating portion 14 retraces and extends parallel to the side 121 to form a second resonating section (not labeled) that is shorter than the first resonating section. Similarly, the first resonating portion 14 retraces a plurality of times and forms a plurality of first resonating sections (not labeled) parallel to the side 121, with a distal end of the first resonating portion 14 connected to the first connecting portion 16. Each first resonating section is longer than the next one closer to the first connecting portion 16. The first resonating portion 14 is correspondingly approximately triangular, with a width of the outer shape of the first antenna unit 10 increasing from the first resonating portion 14 to the first main portion 12.

The first connecting portion 16 is a longitudinal sheet positioned coplanar with the first main portion 12 and the first resonating portion 14. The first connecting portion 16 has one end connected to a distal end of the first resonating portion 14 and another end extending perpendicularly to the side 121 away from the first main portion 12. The first feed portion 18 is a rectangular sheet connected to the extending end of the first connecting portion 16. The first feed portion 18 is positioned in a plane parallel to the side 121 and perpendicular to the plane where the first main portion 12, the first resonating portion 14 and the first connecting portion 16 are positioned.

The second antenna unit 20 includes a second connecting portion 22, a second resonating portion 24, a second main portion 26 and a second feed portion 28. The second connecting portion 22 is a longitudinal sheet positioned coplanar with the first main portion 12, the first resonating portion 14 and the first connecting portion 16. One end of the second connecting portion 22 is connected to a side of the first connecting portion 16.

The second resonating portion 24 is a zigzag sheet connected to the second connecting portion 22 and positioned parallel to the side 122 and perpendicular to the first main portion 12, the first resonating portion 14 and the first connecting portion 16. One end of the second resonating portion 24 is perpendicularly connected to the distal end of the first connecting portion 22, and extends in a zigzag to form a plurality of second resonating sections (not labeled). The second resonating sections are parallel to each other and have substantially the same length.

The second main portion 26 is a rectangular sheet perpendicularly connected to the second resonating portion 24 and positioned parallel to the side 123 and perpendicular to the first main portion 12, the first resonating portion 14 and the first connecting portion 16. The second main portion 26 is parallel to the first feed portion 18. The first main portion 12, the first resonating portion 14, the first connecting portion 16 and the second connecting portion 22 are positioned between the second main portion 26 and the feed portion 18. The second main portion 26 is as wide as a length of the resonating sections of the second resonating portion 24. One end of the second main portion 26 is perpendicularly connected to an outer side of the last resonating section of the second resonating portion 24.

The second feed portion 28 is a rectangular sheet connected to the second main portion 26 and positioned parallel to the side 124 and perpendicular to the first main portion 12, the first resonating portion 14 and the first connecting portion 16. The second feed portion 28 is perpendicularly connected to an end of the second main portion 26 opposite to the end connected to the second resonating portion 22. The second feed portion 28 is parallel to the second resonating portion 24. The first main portion 12, the first resonating portion 14, the first connecting portion 16 and the second connecting portion 22 are positioned between the second resonating portion 24 and the second feed portion 28. Thus, the first feed portion 18, the second resonating portion 24, the second main portion 26 and the second feed portion 28 surround the first main portion 12, the first resonating portion 14 the first connecting portion 16 and the second connecting portion 22.

Figure 2:
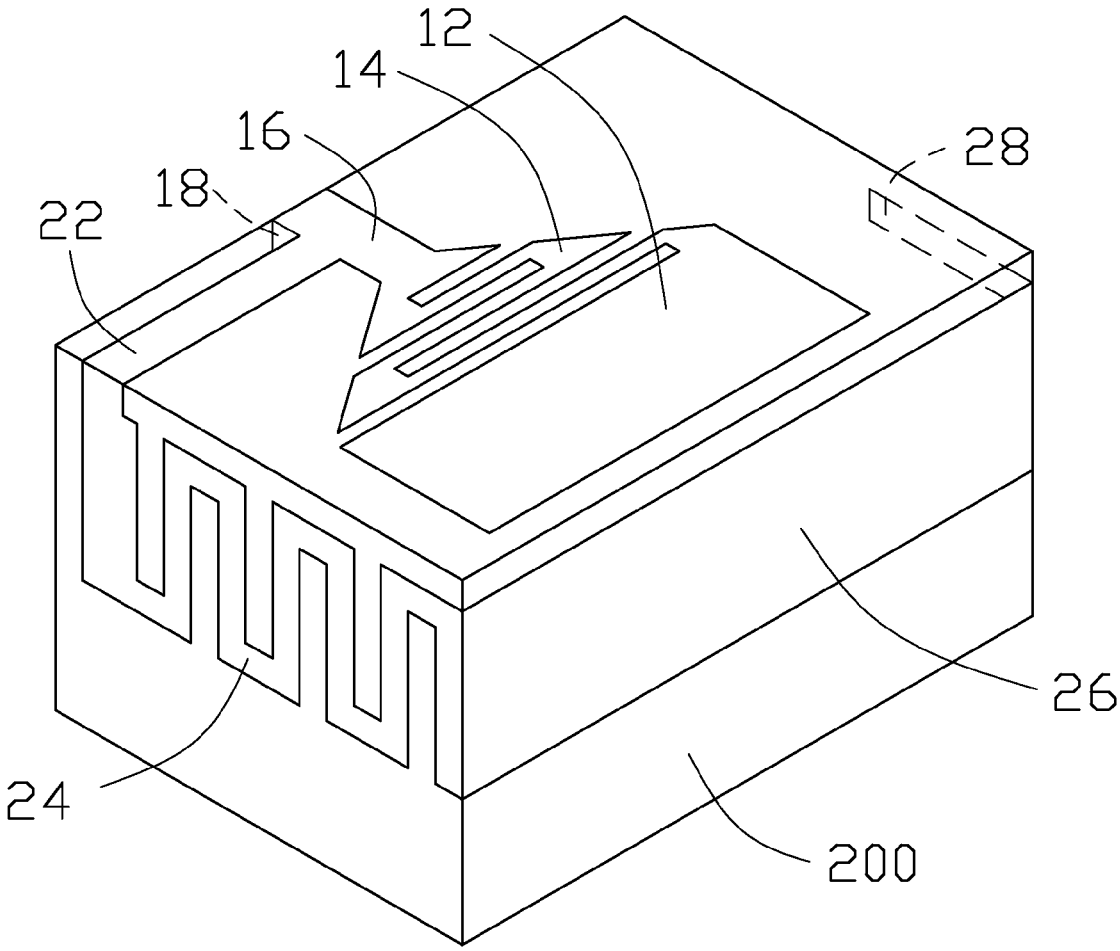
FIG. 2 is a schematic view of the multiband antenna shown in FIG. 1 mounted on a substrate.

Also referring to FIG. 2, the multiband antenna 100 can be supported and protected on a cubic substrate 200. During assembly, the first main portion 12, the first resonating portion 14, the first connecting portion 16 and the second connecting portion 22 are mounted on a top surface of the substrate, and in a same plane. The first feed portion 18, the second resonating portion 24, the second main portion 26 and the second feed portion 28 are respectively mounted on four side surfaces of the substrate, surrounding and perpendicular to the top surface. Thus, each portion of the multiband antenna 100 is flatly attached on the substrate 200, without any portion thereof protruding. An outer shape of an assembly including the substrate 200 and the multiband antenna 200 mounted thereon is also approximately cubic. The multiband antenna 100 is further protected from damage, and the assembly is more easily to be transported and installed.

Figure 3:
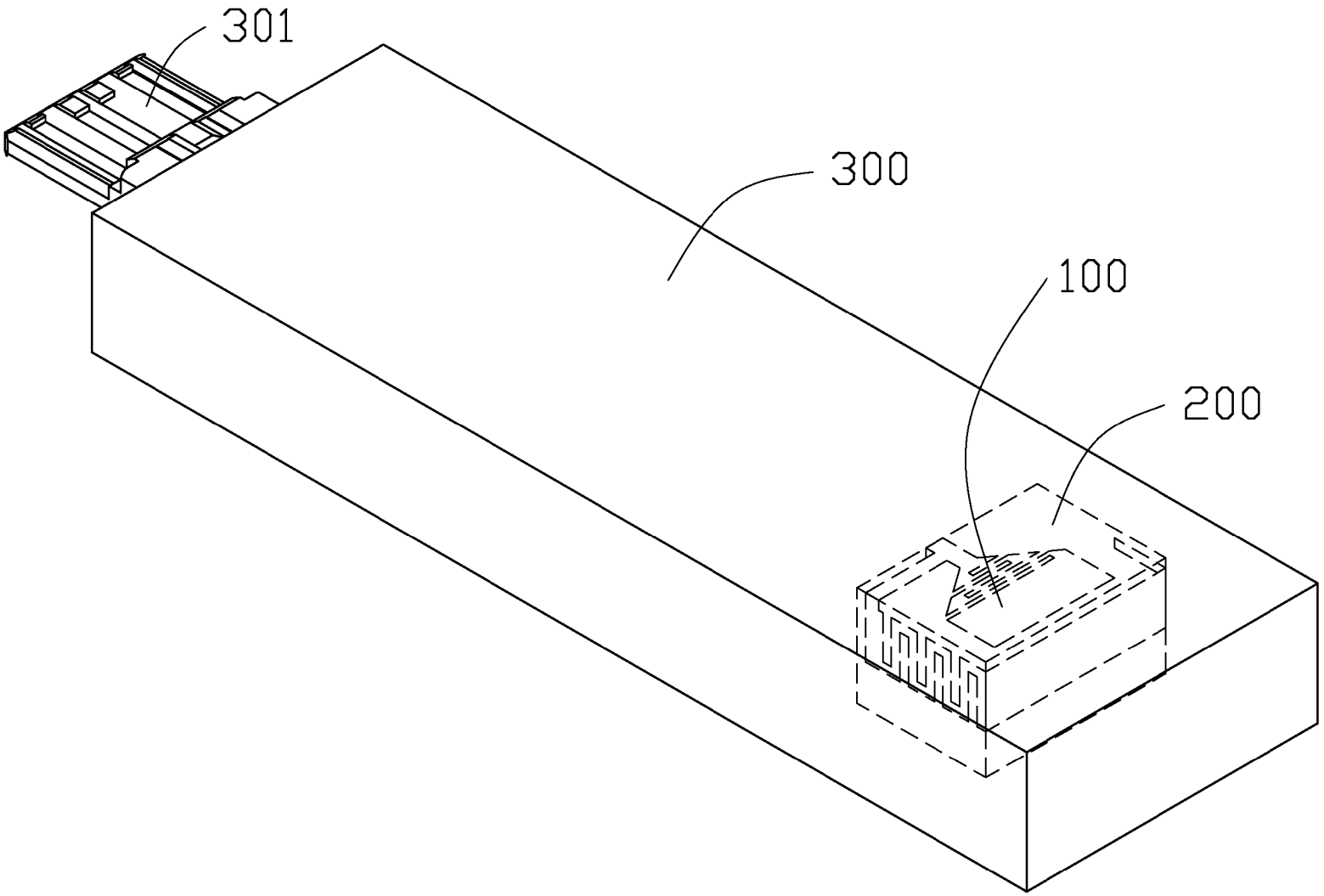
FIG. 3 is a schematic view of the multiband antenna shown in FIG. 1 installed in a wireless card.

Referring to FIG. 3, the assembly including the substrate 200 and the multiband antenna 100 mounted thereon is installed in a wireless card 300. The first feed portion 18 and the second feed portion 28 can be connected to inner circuits (not shown) of the wireless card 300. The wireless card 300 includes an interface 301 (e.g., a USB interface). The wireless card 300 can be connected to a portable electronic device (not shown) through the interface 301, thus the multiband antenna 100 can receive or send wireless signals.

In use, the first antenna unit 10 receives/sends wireless signals having higher frequencies, such as those used in DCS1800, PCS1900 or UMTS2100. The first resonating portion 14 can be used to regulate the working frequency range of the first antenna unit 10. The second antenna unit 20 receives/sends wireless signals having lower frequencies, such as wireless signals used in GSM850 or EGSM900. The second feed portion 28, the second main portion 26 and the second resonating portion 24 surrounding the first antenna unit 10 improve communication quality, and the second resonating portion 24 can regulate the working frequency range of the second antenna unit 20.

As is known, in a frequency band of about 1710 MHz-2200 MHz, which includes communication frequency bands such as DCS1800, PCS1900, UMTS2100, etc., the multiband antenna 100 has an average efficiency of about 76%, with the return loss of the multiband antenna 100 being less than −5 dB. In a frequency band of about 824 MHz-960 MHz, which includes communication frequency bands such as GSM850 and EGSM900, etc., the multiband antenna 100 has an average efficiency of about 54%, and the return loss is less than −3 dB. In both the described high frequency bands and low frequency bands, the multiband antenna 100 is applicable in a 3.5G wireless card.

In fabrication, the numbers of the first resonating sections of the first resonating portion 14 and the second resonating sections of the second resonating portion 24 can be changed according to different working frequency ranges. Thus, the multiband antenna 100 can be used in different kinds of wireless cards.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a first antenna unit for receiving/sending wireless signals having higher frequencies, the first antenna unit including a first main portion, a first resonating portion connected to the first main portion, a first connecting portion connected to the first resonating portion, and a first feed portion connected to the first connecting portion, wherein the first main portion, the first resonating portion and the first connecting portion are all sheets positioned in the same plane, the first connecting portion is longitudinal, one end of the first connecting portion is connected to the first resonating portion, and the other end of the first connecting portion is connected to the first feed portion; and a second antenna unit for receiving/sending wireless signals having lower frequencies than those frequencies received/sent by the first antenna unit, the second antenna unit including a second connecting portion positioned adjacent to the first connecting portion and connected to a side of the first connecting portion, a second resonating portion connected to the second connecting portion, a second main portion connected to the second resonating portion, and a second feed portion connected to the second main portion; wherein the second connecting portion is a sheet positioned coplanar with the first connecting portion, and the second resonating portion is a sheet positioned in a plane that is perpendicular to the plane where the second connecting portion is positioned, and the second main portion is a sheet positioned in a plane that is perpendicular to both the plane where the first connecting portion is positioned and the plane where the second connecting portion is positioned.

2. The multiband antenna as claimed in claim 1, wherein the first feed portion is a sheet positioned in a plane that is perpendicular to both the plane where the first main portion, the first resonating portion and the first connecting portion are positioned and is parallel to the plane where second main portion is positioned.

3. The multiband antenna as claimed in claim 1, wherein the first main portion is a rectangular sheet, and the first resonating portion is a zigzag sheet having one end connected to a corner of the first main portion and another end connected to the first connecting portion.

4. The multiband antenna as claimed in claim 3, wherein the first resonating portion zigzags to form a plurality of parallel first resonating sections, each of which is longer than the next one closer to the first connecting portion.

5. The multiband antenna as claimed in claim 1, wherein a width of the outer shape of the first antenna unit increases from the first resonating portion to the first main portion.

6. The multiband antenna as claimed in claim 1, wherein the second resonating portion is a zigzag sheet positioned perpendicular to the first main portion, the first resonating portion, the first connecting portion and the first feed portion.

7. The multiband antenna as claimed in claim 6, wherein the second resonating portion zigzags to form a plurality of parallel second resonating sections, and all second resonating sections have substantially a same length.

8. The multiband antenna as claimed in claim 6, wherein the second main portion is a rectangular sheet parallel to the first feed portion.

9. The multiband antenna as claimed in claim 8, wherein the second feed portion is a sheet positioned in a plane that is parallel to the plane where the second resonating portion is positioned.

10. The multiband antenna as claimed in claim 1, further comprising a substrate; wherein the substrate is cubic-shaped, the first main portion, the first resonating portion, the first connecting portion, and the second connecting portion are flatly mounted on a top surface of the substrate, and the second resonating portion and the second main portion are respectively flatly mounted on two side surfaces of the substrate that are perpendicular to the top surface.

11. The multiband antenna as claimed in claim 10, wherein the first antenna unit further includes a first feed unit, the first feed unit being a sheet connected to the first connecting portion and flatly mounted on a side surface of the substrate that is parallel to the side surface where the second main portion is positioned.

12. The multiband antenna as claimed in claim 11, wherein the second antenna unit further includes a second feed unit, the first feed unit being a sheet connected to the second main portion and flatly mounted on a side surface of the substrate that is parallel to the side surface where the second resonating portion is positioned.

* * * * *